US005154192A

United States Patent [19]

Sprinkel et al.

[11] Patent Number: 5,154,192

[45] Date of Patent: Oct. 13, 1992

[54] THERMAL INDICATORS FOR SMOKING ARTICLES AND THE METHOD OF APPLICATION OF THE THERMAL INDICATORS TO THE SMOKING ARTICLE

[75] Inventors: F. Murphy Sprinkel, Glen Allen; John M. Campbell, Midlothian; D. Bruce Losee, Jr., Richmond, all of Va.

[73] Assignee: Philip Morris Incorporated, New York, N.Y.

[21] Appl. No.: 381,762

[22] Filed: Jul. 18, 1989

[51] Int. Cl.[5] ..... A24D 1/02; A24D 1/18

[52] U.S. Cl. ..... 131/365; 131/194; 131/359; 131/284

[58] Field of Search ..... 131/284, 365, 194, 360, 131/359, 369

[56] References Cited

U.S. PATENT DOCUMENTS

| | | | |
|---|---|---|---|
| 1,515,222 | 11/1924 | Ruben . | |
| 1,676,536 | 7/1928 | Ferkel . | |
| 1,746,363 | 2/1930 | Schleicher . | |
| 1,894,015 | 1/1933 | Bernstein . | |
| 2,046,863 | 7/1936 | Allphin . | |
| 2,118,144 | 5/1938 | Berman et al. . | |
| 2,137,456 | 11/1938 | Palm, Jr. . | |
| 2,193,439 | 3/1940 | Van Doren . | |
| 2,261,473 | 11/1941 | Jennings . | |
| 2,379,459 | 4/1945 | Schreiber et al. . | |
| 2,490,933 | 12/1949 | Tornquist et al. . | |
| 2,560,537 | 7/1951 | Andersen . | |
| 2,579,738 | 12/1951 | Hargreaves . | |
| 2,782,749 | 2/1957 | Beckett et al. . | |
| 2,809,116 | 10/1957 | Laskowski . | |
| 2,849,005 | 8/1958 | Tucker et al. . | |
| 2,928,791 | 3/1960 | Loconti . | |
| 3,360,338 | 12/1967 | Edenbaum . | |
| 3,465,590 | 9/1969 | Kluth et al. . | |
| 3,523,011 | 8/1970 | Bhiwandker et al. . | |
| 3,576,761 | 4/1971 | Davis . | |
| 3,633,425 | 1/1971 | Sanford . | |
| 3,700,603 | 10/1972 | Rembaum . | |
| 3,785,336 | 1/1974 | Roszkowski . | |
| 3,827,301 | 8/1974 | Parker . | |
| 3,830,224 | 8/1974 | Vanzetti et al. . | |
| 3,874,240 | 4/1975 | Rembaum . | |
| 3,888,631 | 6/1975 | Sturzinger . | |
| 3,895,523 | 7/1975 | Nollen . | |
| 3,943,941 | 3/1976 | Boyd et al. | 131/359 |
| 3,998,210 | 2/1976 | Nosari . | |
| 4,138,357 | 2/1979 | Igarashi . | |
| 4,236,532 | 12/1980 | Schweizer et al. . | |
| 4,240,926 | 12/1980 | McNeeley . | |
| 4,583,558 | 4/1986 | Luke . | |
| 4,643,588 | 2/1987 | Postle et al. . | |
| 4,785,831 | 11/1988 | Hiuchcliffe et al. | 131/362 |
| 4,854,332 | 8/1989 | Hanakura | 131/365 |

FOREIGN PATENT DOCUMENTS

| | | |
|---|---|---|
| 2212349 | 10/1973 | Fed. Rep. of Germany . |
| 1298686 | 11/1962 | France . |
| 2100192 | 12/1982 | United Kingdom . |

*Primary Examiner*—V. Millin

*Attorney, Agent, or Firm*—Gerard A. deBlasi

[57] ABSTRACT

Thermal indicators for non-combustion smoking articles which chemically react when heated to provide visual indications of temperature changes are disclosed. The indicators comprise organic acids, sugars, or amines combined with sugars. The indicators are printed in a variety of patterns along the length of the smoking articles to show temperature changes and to indicate whether the smoking article is finished and should be discarded.

20 Claims, 1 Drawing Sheet

FIG. 1
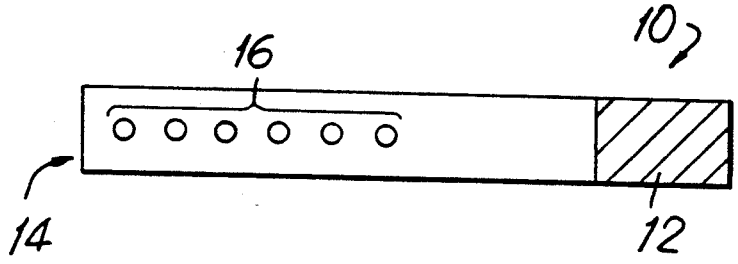
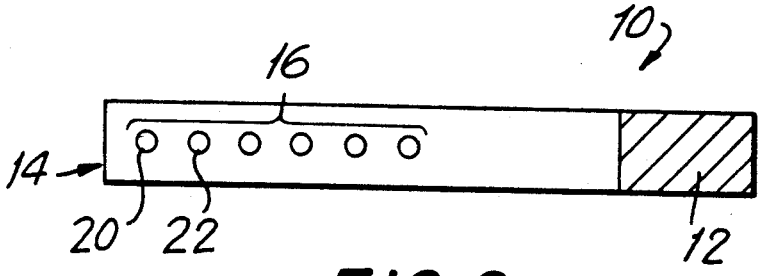
FIG. 2
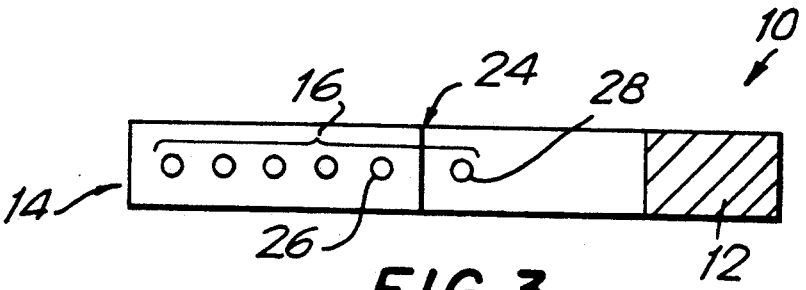
FIG. 3

THERMAL INDICATORS FOR SMOKING ARTICLES AND THE METHOD OF APPLICATION OF THE THERMAL INDICATORS TO THE SMOKING ARTICLE

BACKGROUND OF THE INVENTION

The present invention relates to thermal indicators used on smoking articles. More particularly, this invention relates to thermal indicators embodied as chemicals which change color to indicate a predetermined temperature within the smoking article.

There are non-combustion smoking articles currently on the market that provide an alternative to conventional tobacco-burning smoking articles. Non-combustion smoking articles include smoking articles heated by electrical or chemical means, or by burning some type of heat source other than the tobacco itself. The tobacco or flavor source is heated, but is not burned. If the heat source is contained within the non-combustion smoking article, it provides no visual indication, such as a burning end, of the temperature gradient along the article. A smoker is unable to determine which portion of the smoking article is hot.

A person smoking a non-combustion smoking article must be informed that the device has begun to work. The smoker also needs information about the on-going operation of the device, for example, whether the heat source is still operating. Finally, the smoker must know when to stop puffing because the flavor or heat source is expended. Unless the smoker knows this, the smoker may try to use the device longer than is intended by the manufacturer, possibly resulting in customer dissatisfaction.

The thermal indicators used on smoking articles must not affect the flavor or safety of the smoking articles. The chemicals must be non-toxic both prior to and after heating.

In view of the foregoing, it is an object of this invention to provide non-toxic thermal indicators for use on non-combustion smoking articles.

It is another object of this invention to provide a method for showing the internal thermal status of a non-combustion smoking article along its length.

SUMMARY OF THE INVENTION

These and other objects of the invention are accomplished in accordance with the principles of the invention by providing thermal indicators which react chemically at a predetermined temperature to cause a visible color change. The thermal indicator means of the present invention includes organic acids, sugars, or amines combined with sugars, which are applied to a surface of the smoking article to be monitored. The compounds used for the indicators may be of a variety of concentrations and may be applied to the surface of the smoking article in different quantities.

The thermal indicators may be applied to smoking articles in a variety of patterns using conventional printing techniques. The indicators are printed along the longitudinal length of the smoking articles. As the internal temperature gradient of the article moves down the length of the article, the indicators gradually change color in response to the increased heat.

Further features of the invention, its nature and various advantages will be more apparent from the detailed description of the invention and the accompanying drawings.

DETAILED DESCRIPTION OF THE PREFERRED EMBODIMENTS

Figure 1:
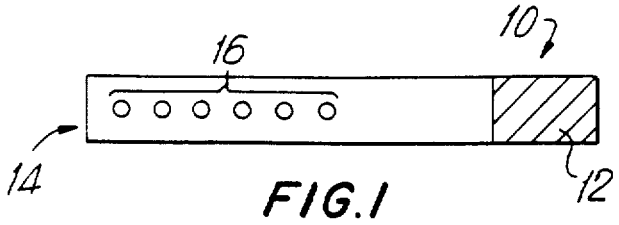
FIG. 1 shows a non-combustion smoking article with an illustrative pattern of thermal indicators in accordance with the principles of this invention.

Referring to FIG. 1, as the smoker draws on the proximal end of smoking article 10, air is drawn though distal end 14, past the internal heat source of the smoking article, causing the air to become heated. The heated air and flavored aerosol (which is released from the flavor source disposed within smoking article 10) are drawn down the length of the smoking article, through the filter 12, and into the smoker's mouth. Often, non-combustion smoking articles (to which the thermal indicators of this invention may be applied) are lined with foil. The foil conducts heat, gradually, back toward filter 12. As smoking progresses, an internal temperature gradient is created within smoking article 10. By placing the thermal indicators of this invention along the length of article 10, the internal temperature gradient of the smoking article may be detected. The smoking article is hottest at distal end 14 where the device is lit or otherwise initially heated, and cooler toward filter 12. The heated aerosol, heat-conducting foil, and possibly the heat source itself (e.g., a carbon rod burning toward filter 12) cause the temperature to increase down the length of article 10 as smoking continues. It is this temperature gradient which causes certain indicators to heat sufficiently to cause a color change, while indicators located on cooler portions of the smoking article remain invisible (i.e., they have not been sufficiently heated to cause a chemical reaction).

FIG. 1 shows a smoking article 10 imprinted with thermal indicators collectively indicated by reference numeral 16. In an illustrative embodiment of this invention, the thermal indicators are printed in a series of small dots. Indicators 16 are printed at distal end 14 and down the length of smoking article 10. In alternative embodiments of the invention, indicators 16 may be printed or sprayed onto the outer surface of smoking article 10 as lines or letters, or in any of a variety of patterns.

Figure 2:
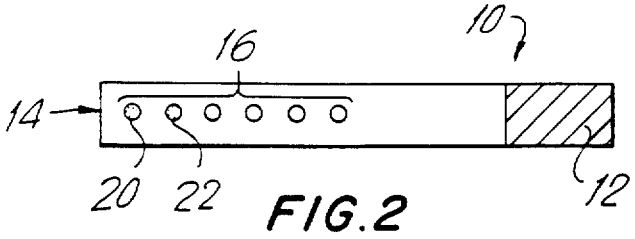
FIG. 2 is the smoking article of FIG. 1 showing two indicators that have changed color in response to the internal heating of the smoking article.

FIG. 2 shows the smoking article of FIG. 1 after the device has begun to operate. Before article 10 is smoked, all of the indicators 16 are invisible (as shown in FIG. 1). At the beginning of smoking, distal end 14 is the first portion of article 10 to experience a temperature rise. Therefore, the indicator 20 closest to distal end 14 begins to darken first. As smoking progresses, indicator 20 darkens. Thermal indicator 22 will be the next to darken, as the internal temperature gradient progressively moves toward the proximal end. In this way, the smoker is alerted that smoking article 10 is still hot and is still operating.

Figure 3:
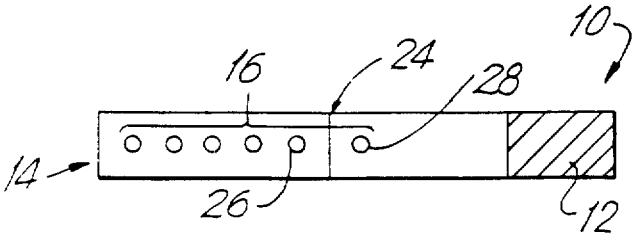
FIG. 3 is the smoking article of FIG. 1 showing an illustrative marking used to indicate when the smoking article is finished.

FIG. 3 shows the smoking article of FIG. 1, having means for indicating when smoking article 10 is finished. This embodiment is particularly suited for smoking articles comprising a heat source which extends longitudinally down the length of the article and heats gradually from distal end 14 toward filter 12 (such as a burning carbon rod).

In FIG. 3, a marking 24 is printed on the surface of smoking article 10 of FIG. 1. Marking 24 is preferably printed in ink, but may also be printed with the same compound as indicators 16. Marking 24 is disposed before the thermal indicator closest to filter 12, i.e., between indicators 26 and 28. Thermal indicator 28, located beyond marking 24, changes color when the area surrounding the proximal end of article 10 becomes hot. This may occur, for example, when a heat source, such a burning rod of carbon, burns to the end of article 10. Indicator 28 alerts the smoker that smoking article 10 is finished and should be discarded.

In another embodiment, indicators 26 and 28 include greater chemical concentrations, and therefore become darker when heated, than the indicators closer to distal end 14. In this embodiment, marking 24 is unnecessary; the darker color of indicators 26 and 28 alert the smoker that the device is finished.

Thermal indicators in accordance with this invention may be applied to smoking articles using standard methods of printing on cigarette wrappers. Preferably, the indicators are applied to the smoking article by means of a print wheel. In an alternative embodiment, spray Jets are used to apply the thermal indicators.

Use of a print wheel or spray jet requires a solid content of at least 30 percent solids in the material to be applied. It is preferable to combine the indicator compound with a high viscosity agent, such as corn syrup, prior to printing. The high viscosity additive makes the indicator compound more suitable for printing on paper, because the indicator will be less likely to run or streak. The viscosity agent allows the indicators of this invention to be printed on the cigarette paper at high speeds. Viscosity agents such as corn syrup may also provide additional sugars, which may participate in the chemical reaction that cause the indicators to change color.

Thermal indicators of the present invention are chemical compounds in the form of solutions or slurries (in water) of organic acids, sugars, or amines combined with sugars. Heat from the operation of the smoking article causes the indicators disposed on the outer surfaces of the device to react chemically, and to change color. Prior to heating, and the subsequent chemical reaction, the indicators remain invisible, and thus do not affect the appearance of the smoking article. The chemical reactions creating the color changes are substantially independent of the paper and the materials which may be present on the paper to prevent the paper from being burned or charred. However, the surface properties of the paper may affect the chemical reactions.

Organic acids, applied in a solution, are the first class of chemicals which react when heated to cause a distinctive tanning or browning of the surface to which they are applied. Solutions of between five percent and 85 percent organic acids by weight may be used. As the concentration of organic acids is increased, the color intensity upon heating is increased. Thus, the indicator color can be regulated, and the appearance of the cigarette wrapper can be controlled.

In the preferred embodiment, a saturated solution or a concentration solution of approximately 50 percent organic acid by weight is used for the indicator. Although color intensity generally increases as the indicator solutions become more concentrated, solutions of 50 percent organic acid produce color indications substantially similar to solutions of greater concentrations. It is therefore more cost effective to use solutions of 50 percent concentration. In an alternative embodiment, the indicator is a slurry of an organic acid in water.

Examples of organic acids which may be used as indicators include ascorbic acid and citric acid. For example, ascorbic acid will cause a substantially tan color indication when heated to approximately 135 to 155 degrees Centigrade, a brown color indication when heated to approximately 155 to 180 degrees Centrigrade, and a dark brown color indication when heated to approximately 180 to 200 degrees Centrigrade. The indicator color is continuously variable with temperature over these temperature ranges.

Sugars are a second class of chemical compounds which may be used as thermal indicators on smoking articles. Examples of compounds from this class which react when heated to create color changes include solutions of sucrose, dextrose, or fructose. The preferred solvent for these solutions is alcohol. Other solvents that may be used include water, ketone, and aldehyde. When heated, indicators composed of these compounds carmelize and turn brown in an elimination reaction. At high temperatures, the sugars carbonize and turn black.

Solutions of at least five percent sugar by weight are required to create a visible color change. Similar to the organic acid indicators, the intensity of the color change increases as the concentration of sugar in the solution increases. It is preferable to use sugar concentrations of at least 40 percent by weight, because at higher sugar concentrations, such indicators give off a "caramel type" odor as an additional indication of high temperatures. This odor is emitted by the sugar thermal indicators both during carmelization and carbonization.

The third class of chemicals suitable for use on smoking articles which cause a color change when heated are amines combined with sugars. A solution of asparagine and fructose is an example of compounds in this class which react to cause a color change when heated. This combination of compounds causes a tan-brown color indication at temperatures of approximately 140 degrees Centrigrade. The amine (asparagine) reacts with the sugar (fructose) when heat is applied in a "browning" or "Amadori" reaction. Indicators of this type cause surface browning and release volatile compounds thereby providing both visual and olfactory signals to indicate that the smoking article is hot.

It will be understood that the foregoing is merely illustrative of the principles of the invention, and that various modifications can be made by those skilled in the art without departing from the scope and spirit of the invention. For example, a continuous line formed of indicator material may be printed down the length of smoking article 10, in place of the pattern of dots, in the embodiment of FIG. 1.

I claim:

1. A method for determining whether a non-combustion smoking article is at a predetermined operating state, comprising the steps of:

applying a non-toxic fluid that changes color at a predetermined temperature to an outer surface of the smoking article in a predetermined pattern from a distal end to a first predetermined point during manufacture of the smoking article;

marking the smoking article at a second predetermined point along its length, between said distal end and said first predetermined point, during manufacture; and monitoring the portion of the length of said smoking article that contains the temperature-sensitive fluid during smoking for color changes indicating that the smoking article is at said predetermined operating state.

2. The method defined in claim 1 wherein said marking at said second predetermined point is printed with ink.

3. A non-combustion smoking article having a system for visually indicating internal temperature changes, comprising:

a cylindrical member forming an outer surface of the smoking article; and a non-toxic medium that changes color at a predetermined temperature that is disposed on the outer surface of the smoking article from the distal end to a predetermined point in a predetermined pattern.

4. The article defined in claim 3 wherein said predetermined pattern comprises a series of dots extending from the distal end of said smoking article to a predetermined point.

5. The article defined in claim 3 wherein said medium comprises a solution of a solvent and a compound from the class of compounds known as organic acids.

6. The article defined in claim 5 wherein said solvent is a compound selected from among the group consisting of alcohols, water, ketone, and aldehyde.

7. The article defined in claim 5 wherein said compound is ascorbic acid.

8. The article defined in claim 5 wherein said compound is citric acid.

9. The article defined in claim 3 wherein said medium comprises a solution of a solvent and a compound from the class of compounds known as sugars.

10. The article defined in claim 9 wherein said solvent is a compound selected from among the group consisting of alcohols, water, ketone, and aldehyde.

11. The article defined in claim 9 wherein said compound is sucrose.

12. The article defined in claim 9 wherein said compound is dextrose.

13. The article defined in claim 9 wherein said compound is fructose.

14. The article defined in claim 3 wherein said medium comprises a solution of a solvent and the combination of a compound from the class of compounds known as amines with a compound from the class of compounds known as sugars.

15. The article defined in claim 14 wherein said solvent is a compound selected from among the group consisting of alcohols, water, ketone, and aldehyde.

16. The article defined in claim 14 wherein said amine and said sugar are asparagine and fructose, respectively.

17. The article defined in claim 3 wherein said medium comprises a slurry of a solid organic acid in a solvent.

18. The article defined in claim 17 wherein said solvent is a compound selected from among the group consisting of alcohols, water, ketone, and aldehyde.

19. A non-combustion smoking article having a system for visually indicating whether the article has reached a predetermined operating state, comprising:

a cylindrical member forming an outer surface of the smoking article;

a non-toxic medium that changes color at a predetermined temperature, disposed on said outer surface and along the length of the smoking article in a predetermined pattern from a distal end to a first predetermined point; and a marking for indicating when the article has reached a predetermined operating state, disposed at a second predetermined point between said distal end and said first predetermined point.

20. The article defined in claim 19 wherein said marking is printed with ink.

* * * * *

UNITED STATES PATENT AND TRADEMARK OFFICE

CERTIFICATE OF CORRECTION

PATENT NO. : 5,154,192

DATED : October 13, 1992

INVENTOR(S) : F. Murray Sprinkel et al.

It is certified that error appears in the above-indentified patent and that said Letters Patent is hereby corrected as shown below:

IN THE DRAWINGS

FIG. 2, indicators 20 and 22 should be darkened as shown on the attached page.

Column 2, line 18, "though" should be -- through --.

Column 3, line 14, after "such" should be inserted -- as --.

Column 3, line 28, "Jets" should be -- jets --.

Column 3, line 40, "reaction" should be -- reactions --.

Column 4, line 58, "I" should be -- We --.

Signed and Sealed this

Twenty-ninth Day of March, 1994

Bruce Lehman

*Attest:*

*Attesting Officer*

BRUCE LEHMAN

*Commissioner of Patents and Trademarks*